United States Patent [19]

Crowell et al.

[11] Patent Number: 4,731,152

[45] Date of Patent: Mar. 15, 1988

[54] SHOE SUBSTRATE REINFORCING MACHINE

[75] Inventors: Douglas H. Crowell, Beverly; John F. Martin, Essex; Albert I. Morse, Beverly; Lawrence P. Ciccia, Medford, all of Mass.

[73] Assignee: DVSG Patentverwaltungs, Frankfurt, Fed. Rep. of Germany

[21] Appl. No.: 851,841

[22] Filed: Apr. 14, 1986

[51] Int. Cl.[4] ..... B05C 13/00

[52] U.S. Cl. ..... 156/580; 12/123; 118/503; 156/568; 269/90

[58] Field of Search ..... 156/580, 583.8, 568; 118/503; 269/238, 90; 100/219, 233; 12/123, 51, 54.1

[56] References Cited

U.S. PATENT DOCUMENTS

| | | | |
|---|---|---|---|
| 536,093 | 3/1895 | Neely | 100/219 |
| 2,624,389 | 1/1953 | Bungay | 100/233 |
| 2,731,948 | 1/1956 | Fleming | 118/253 |
| 3,680,478 | 8/1972 | Beachner, Jr. et al. | 100/233 |
| 4,462,153 | 7/1984 | DeBortoli | 269/238 |
| 4,502,411 | 3/1985 | Gilbride et al. | 269/238 |
| 4,659,420 | 4/1987 | Morse et al. | 156/556 |
| 4,685,418 | 8/1987 | Morse | 118/503 |

*Primary Examiner*—Michael Wityshyn

[57] ABSTRACT

A shoe substrate reinforcing machine for depositing a powder in a selected configuration, fusing the configured powder into a laminate and adhering the fused laminate to a shoe substrate. The machine has a work transfer device which will receive and clamp a shoe part and displace the clamped shoe part to a joint location to adhere the shoe part to a fused laminate. The work transfer device has a support pad on which a shoe part is to be clamped and a clamping structure which includes a lever arm on either side of the support pad each of which includes one or more catches. A swivel bracket assembly includes a swivel bracket having a connecting pin which is releasably secured in the catch and clamps which are secured to the swivel bracket.

3 Claims, 2 Drawing Figures

SHOE SUBSTRATE REINFORCING MACHINE

Figure 1:
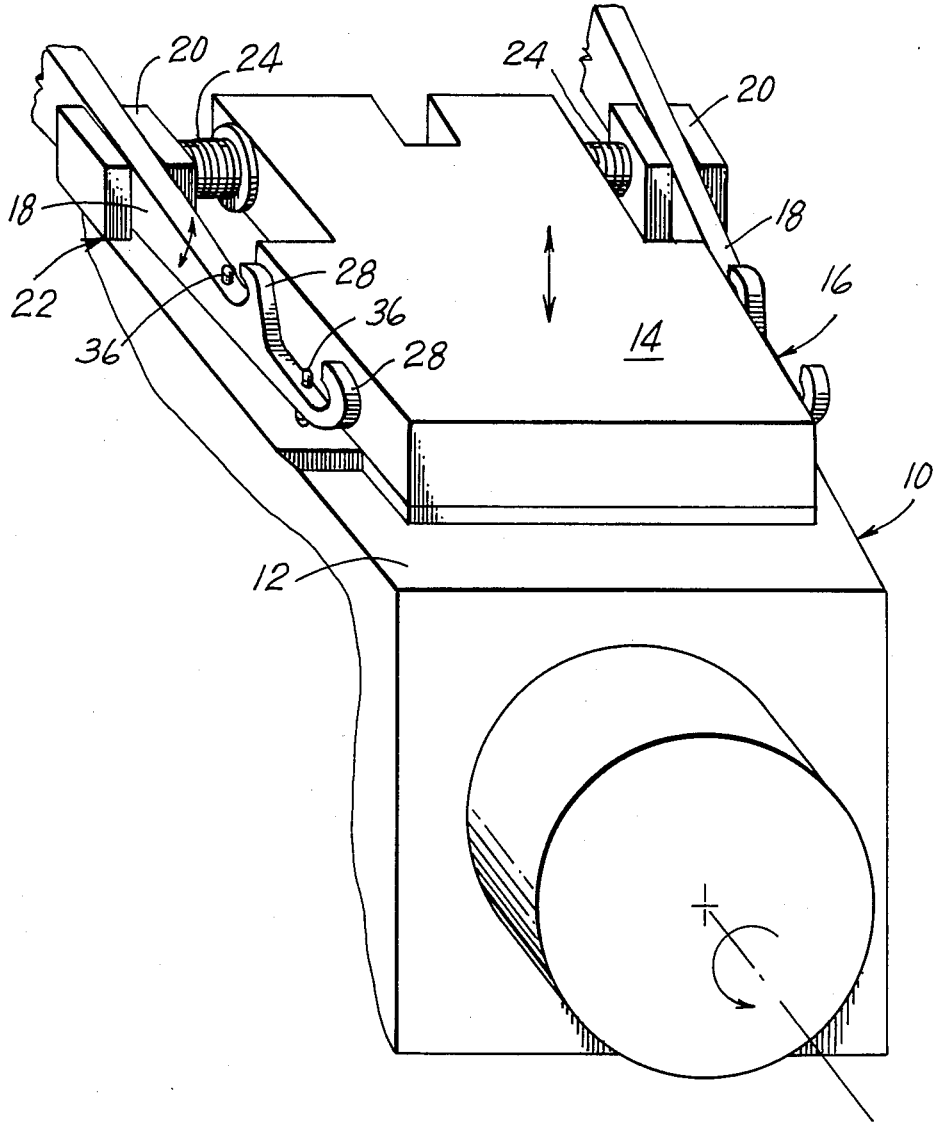

The present invention relates to shoe substrate reinforcing machines which deposit powder in a selected configuration, fuse the configured powder into a laminate and adhere the fused laminate to a shoe substrate to reinforce the shoe substrate.

These machines utilize a multifaced transfer mechanism to deliver a shoe substrate to be reinforced to the location where a fused laminate will be adhered to the shoe substrate. Each face (conventionally four) of the transfer mechanism has a mounting plate assembly which can be elevated from a release position to a clamp position. Such displacement controls a pair of clamps located at either side of the mounting plate assembly to releasably clamp a shoe substrate on the mounting plate assembly. Since shoe substrates have a variety of shapes, a variety of clamping pads are required. Conventionally, a clamping pad is fastened by machine screws to its associated clamping arm.

It is an object of the present invention to provide a novel clamping arrangement that will permit rapid changing of the clamp pads so that different substrates can be easily accommodated.

Other objects and advantages of the present invention will become apparent from the following portion of this specification and from the following drawings which illustrate in accordance with the mandate of the patent statutes, a presently preferred embodiment of the invention.

Figure 2:
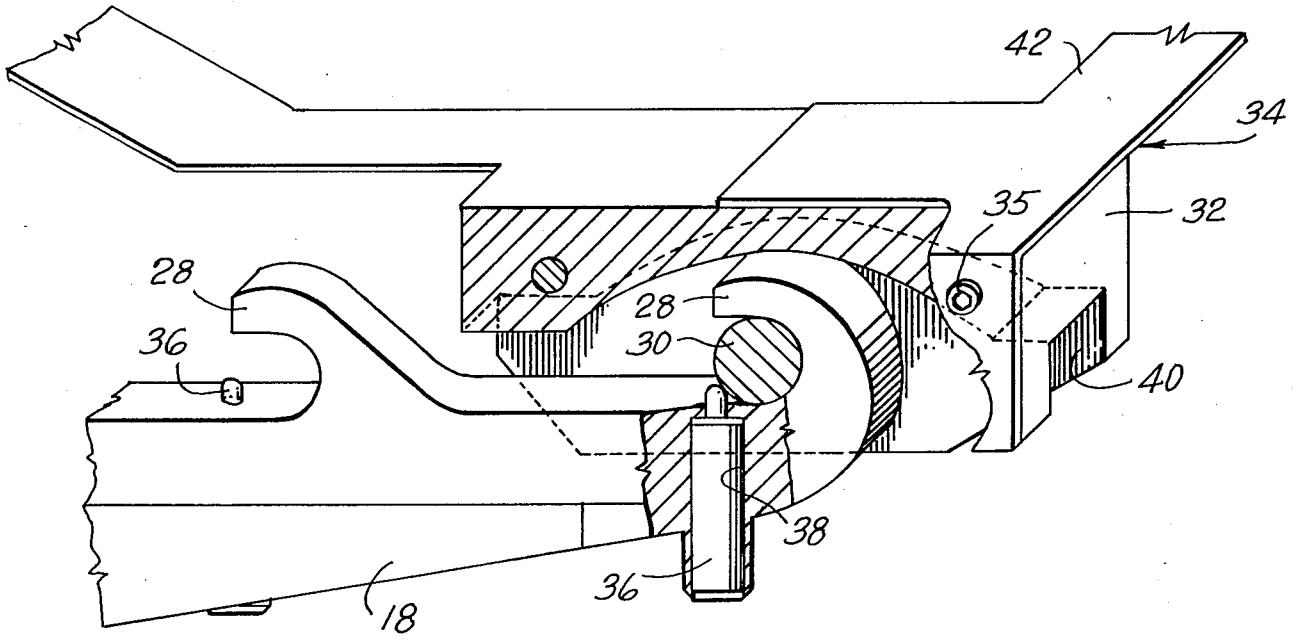

Referring to the drawings:

FIG. 1 is a top oblique view of a portion of the work transfer cube of a shoe substrate reinforcing machine which deposits powder in a selected configuration, fuses the configured powder into a laminate and adheres the fused laminate to a shoe substrate to reinforce the substrate. Only one of the faces is shown; and FIG. 2 is a side oblique view of the forwardmost portion of a lever arm illustrated in FIG. 1 with the clamp arm releasably secured to a clamping fixture. A shoe substrate reinforcing machine which deposits powder in a selected cofiguration, fuses the powder into a laminate and adheres the laminate to a shoe substrate to reinforce the shoe substrate, utilizes a work transfer device (a cube 10 having four faces 12). The work transfer cube is mounted on a spindle (not shown) which is indexable around a horizontal axis to four 90° positions. The top or upper horizontal face 12 is the load/unload face where a shoe substrate to be reinforced (not shown) can be clamped in position on the support pad 14 of a mounting assembly 16. A clamped shoe substrate will be rotated 180° to a join and cool station where the transfer cube will be lowered into forceful engagement with a fused laminate to adhere the laminate to the shoe substrate. Complete details of the work transfer cube and conventional clamping structure are illustrated in detail in U.S. Pat. No. 4,502,411.

Each clamping assembly which clamps a substrate to the mounting assembly includes a lever arm 18 which is pivotally supported between a pair of posts 20 of a mounting bracket 22. As shown in detail in the '411 patent the lever arm is maintained in continuous cooperation with the mounting assembly by a spring element 24 so that movement of the mounting assembly from a lowered position to an elevated position will pivot the lever arms 18 from an elevated release position to a lowered clamping position where a substrate can be clamped against the support pad 14 of the mounting assembly 16.

The forward end of each lever arm 18 has a pair of "C" shaped pin receiving catches 28 which are adapted to matingly receive the connecting pin 30 of a swivel bracket 32 to which a clamp 34 is secured. Detent mechanisms in the form of a latching plunger 36 having a threaded outer diameter are threadedly received in suitable threaded lever arm bores 38 and releasably latch the connecting pin 30 within a catch. The swivel bracket 32 has a slot 40 defined in its bottom surface permitting entrance of a pin receiving catch 28 within the swivel bracket 32 to releasably catch the connecting pin 30. The slot and catch portions of the lever arm have approximately the same width so that the clamping surface will have a constant location relative to the lever arm. The clamp 34, which is secured to the swivel bracket 32 by suitable fasteners 35, has a selectively configured clamping surface 42 which is designed to overlay and clamp a shoe substrate (not shown) positioned on the support pad 14 when the mounting assembly is elevated to the clamp position.

A latching plunger 36 locates the swivel bracket pin 30 within a catch 28, but swivel bracket 32 is rotatable about the connecting pin 30 during the clamping operation to establish the desired mating engagement between the clamping surface and the clamped shoe substrate. The orientation of the catch is chosen so that during clamping, the pin 30 will be locked within the catch.

What is claimed is:

1. A shoe substrate reinforcing machine for depositing a powder in a selected configuration, fusing the configured powder into a laminate and adhering the fused laminate to a shoe substrate to reinforce the substrate, said machine comprising a work transfer device adapted to displace a shoe substrate clamped thereon to a join station where a fused laminate can be adhered thereto, said work transfer device including a substrate mounting assembly having a support pad, and clamp means on either side of said support pad each including a lever arm, and swivel bracket means, said lever arm having a catch and detent means on the lever arm cooperating with said catch for releasably securing a connecting pin within said catch, and said swivel bracket means having a slot for slidably receiving said catch and including a connecting pin extending across said slot for insertion into said catch as said swivel bracket means is connected to said lever arm, said slot being selectively configured so that said swivel bracket can be reoriented around said pin but will be held in said catch by said pin when said clamp means is clamped on the support pad.

2. A shoe machine according to claim 1, wherein each of said lever arms includes a pair of catches and a pair of associated detent means.

3. A shoe machine according to claim 2, wherein said detent means is threadedly received by said lever arm.

* * * * *